US005618396A

United States Patent [19]

Hiermaier et al.

[11] Patent Number: 5,618,396

[45] Date of Patent: Apr. 8, 1997

[54] HOLDING AND CONTACTING APPARATUS FOR GALVANICALLY COATING WORK PIECES

[75] Inventors: Manfred Hiermaier, Groebenzell; Paul Buenger, Munich; Willi Buchecker, Tittling, all of Germany

[73] Assignee: MTU Motoren- und Turbinen-Union Muenchen GmbH, Munich, Germany

[21] Appl. No.: 480,896

[22] Filed: Jun. 7, 1995

[30] Foreign Application Priority Data

Jun. 8, 1994 [DE] Germany ..... 44 19 982.1

[51] Int. Cl.[6] ..... C25D 17/06

[52] U.S. Cl. ..... 204/297 M

[58] Field of Search ..... 204/297 M, 297 W; 269/8

[56] References Cited

U.S. PATENT DOCUMENTS 2,911,347 11/1959 Gutzmer ..... 284/297 M

FOREIGN PATENT DOCUMENTS 520334 2/1931 Germany .
2537362 3/1977 Germany .

*Primary Examiner*—John Niebling
*Assistant Examiner*—Brendan Mee
*Attorney, Agent, or Firm*—W. G. Fasse; W. F. Fasse

[57] ABSTRACT

Work pieces to be galvanically coated or plated are held in place with a good electrical contact by a holding device having an electrically conducting hollow carrier (2), a magnet (3) removably mounted inside said hollow carrier (2) the ends of which are closable for protection of the magnet in a galvanic bath. A cover (4), with receptacles (28) or bore holes in which the work pieces or parts (12) are received, is clamped to the carrier (2) by a releasable clamping device (5). The magnet (3) is arranged alongside a contact surface (19) through which the magnet holds the parts (12), since the pole axis (P) of the magnet (3) extends perpendicularly to the contact surface (19) which may be formed by a machined surface of a carrier wall or by an electrically conducting ferromagnetic plate secured to the carrier.

36 Claims, 4 Drawing Sheets

HOLDING AND CONTACTING APPARATUS FOR GALVANICALLY COATING WORK PIECES

CROSS-REFERENCE TO RELATED APPLICATION

The disclosure of the present application is related to the disclosure of our copending application Ser. No. 08/480,895, filed on the same date as the present application and entitled: "GALVANIZING MAGAZINE FOR COATING WORK PIECES", now U.S. Pat. No. 5,536,377.

FIELD OF THE INVENTION

The invention relates to a holding and contacting apparatus or carrier for galvanically coating or plating work pieces, especially large numbers of small work pieces referred to herein as "parts". Such an apparatus includes at least one magnet for holding the parts on at least one contact surface of an electrically conducting parts carrier which is connectable to a galvanizing current supply source.

BACKGROUND INFORMATION

Carriers of this type are also referred to as plating racks and serve for holding metal parts to be plated with an electric contact necessary for the plating operation such as hard chromium plating in a galvanic bath in which the parts are immersed. In order to avoid the labor intensive removing of parts from one carrier and attaching these parts to another carrier for different operational steps in a plating process, it is desirable to keep the parts held in place on the same carrier for all such steps as rinsing, roughening, plating, and drying. However, the prior art leaves substantial room for improvement in this respect.

The quality of the plating or coating, especially the thickness and the uniformity of the coating over the coated surface area is substantially influenced by the quality of the electrical contact between the part to be plated and the electrode holding the part in the bath during the plating operation. Any disturbances in the electrical contact adversely affect the coating or plating quality.

Even a small out-of-alignment positioning of a part relative to the current carrying section of the carrier also referred to as "electrode" can cause the plating current density to fall below the critical current density necessary for an effective electrolytic deposition. Such critical current densities are within the range of 20 to 80 A/cm$^2$. Thus, the contact between the part and the electrode determines the reject quota in any particular plating batch.

Attempts have been made heretofore to improve the contacting between the part and the electrode by mechanical contact springs. However, such contact springs are not efficient where large number of parts are to be plated because mechanical damage to the clamped parts is hard to avoid and because the mounting of the parts to the electrode by the clamps is not only very labor intensive, it is also tedious work that has heretofore resisted automation.

A further problem is seen in the requirement that certain parts are to be plated only on a particular surface area while leaving other surface areas of the part free of the plating or coating. Efforts to solve this masking problem heretofore are also very labor intensive due to the use of masking tapes, masking lacquers, protective coatings or the like that must be applied prior to the galvanic plating operation.

OBJECTS OF THE INVENTION

In view of the above it is the aim of the invention to achieve the following objects singly or in combination:

to construct an electrode of the type described above in such a way that the parts can be simply loaded and unloaded from the electrode even in an automatic operation;

to assure a good electrical contact between the parts and the electrode, whereby such good electrical contact must be consistently repeatable for all parts to be plated;

to avoid mechanical damage to the parts during loading of the electrode with the parts and also during unloading of the parts from the electrode;

to assure a reliable and precise magnetic adherence of the parts to the contact surface of the carrier;

to effectively cover or mask those surface portions of the parts that are not to be coated or plated; and to make sure that a good electrical contact cannot be disturbed, especially during the coating operation.

SUMMARY OF THE INVENTION

The above objects have been achieved by a holding and contacting device according to the invention by a carrier for the galvanic coating or plating of parts having at least one magnet for holding the parts on at least one contact surface of the carrier made of electrically conducting material and connectable to a current source, wherein the electrically conducting contact surface extends outside on and along the parts carrier formed as a hollow member, such as a pipe section, enclosing a hollow channel in which the magnet is received in such a way that a pole axis of the magnets extends perpendicularly to the contact surface. Preferably, the contact surface is formed, for example, by an electrically conducting ferromagnetic plate or strip secured to an outside surface of the hollow channel.

The just described carrier construction according to the invention has the advantage that the magnet which assures the certain and consistent electrical contact between the parts and the contact surface is arranged coaxially and centrally in the hollow channel of the parts carrier which is closed at both ends. This feature protects the magnet against corrosion by the galvanic bath and by any rinsing bath, whereby a reliable adherence of the parts to the contact surface is assured even for prolonged periods of an operational life of the present carrier. Another advantage is seen in that the force of the magnet is optimally utilized because the pole axis of the magnets extends cross-wise or perpendicularly to the contact surface and is thus oriented toward the parts. Due to this orientation of the magnet pole axis to the contact surface, the longitudinal axis of the respective part and the pole axis coincide. The current flow in the bath is free of disturbances during the plating operation because the current passes directly from the electrical contact surface into the wall of the hollow parts carrier. The parts carrier in turn is directly connected with the current supply to the bath. As a result, the length of the current path between parts and the current supply or current contact is short and transition resistances are kept small. Further, the surface area of the contact surface can be easily dimensioned to be sufficient for the current density required for an effective electrolytic plating or deposition.

The disclosure content of the above cross-referenced copending application is incorporated by reference herein as part of the present disclosure. The present carriers can be assembled to form a galvanizing magazine as disclosed in the copending application.

BRIEF DESCRIPTION OF THE DRAWINGS

In order that the invention may be clearly understood, it will now be described, by way of example, with reference to the accompanying drawings, wherein:

FIG. 2 is shown on a somewhat enlarged scale compared to FIG. 1;

DETAILED DESCRIPTION OF PREFERRED EXAMPLE EMBODIMENTS AND OF THE BEST MODE OF THE INVENTION

Figure 2:
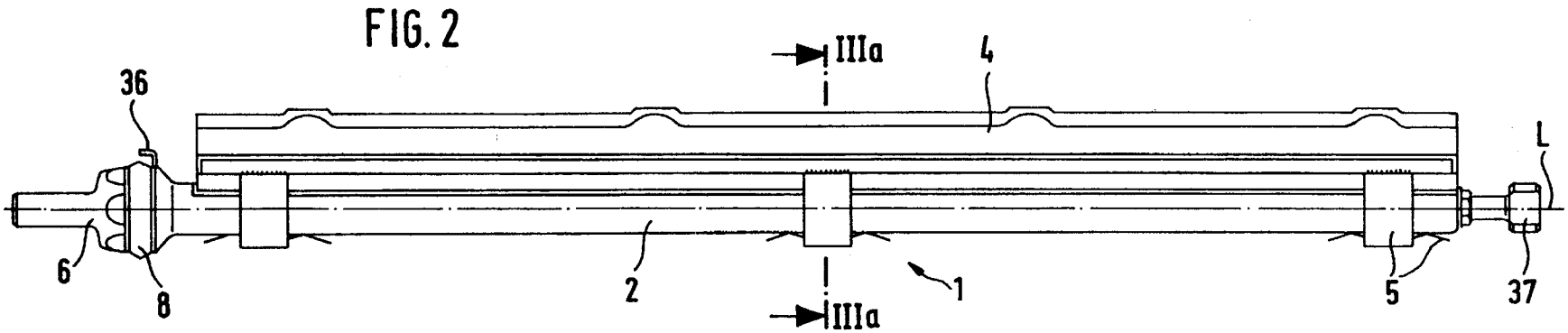
FIG. 2 is a side view of the assembled components shown in FIG. 1, whereby
Figure 1:
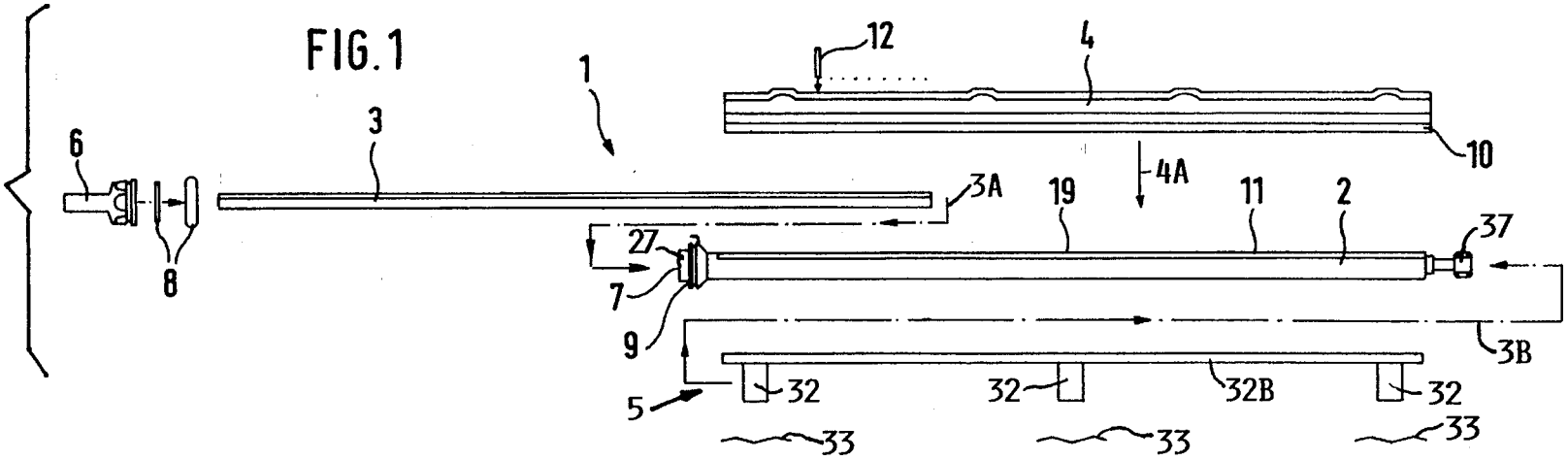
FIG. 1 is an exploded side view of the components of a holder and contacting device or carrier according to the invention, whereby the dash-dotted lines indicate the assembly of the components to form the carrier.
Figure 3A:
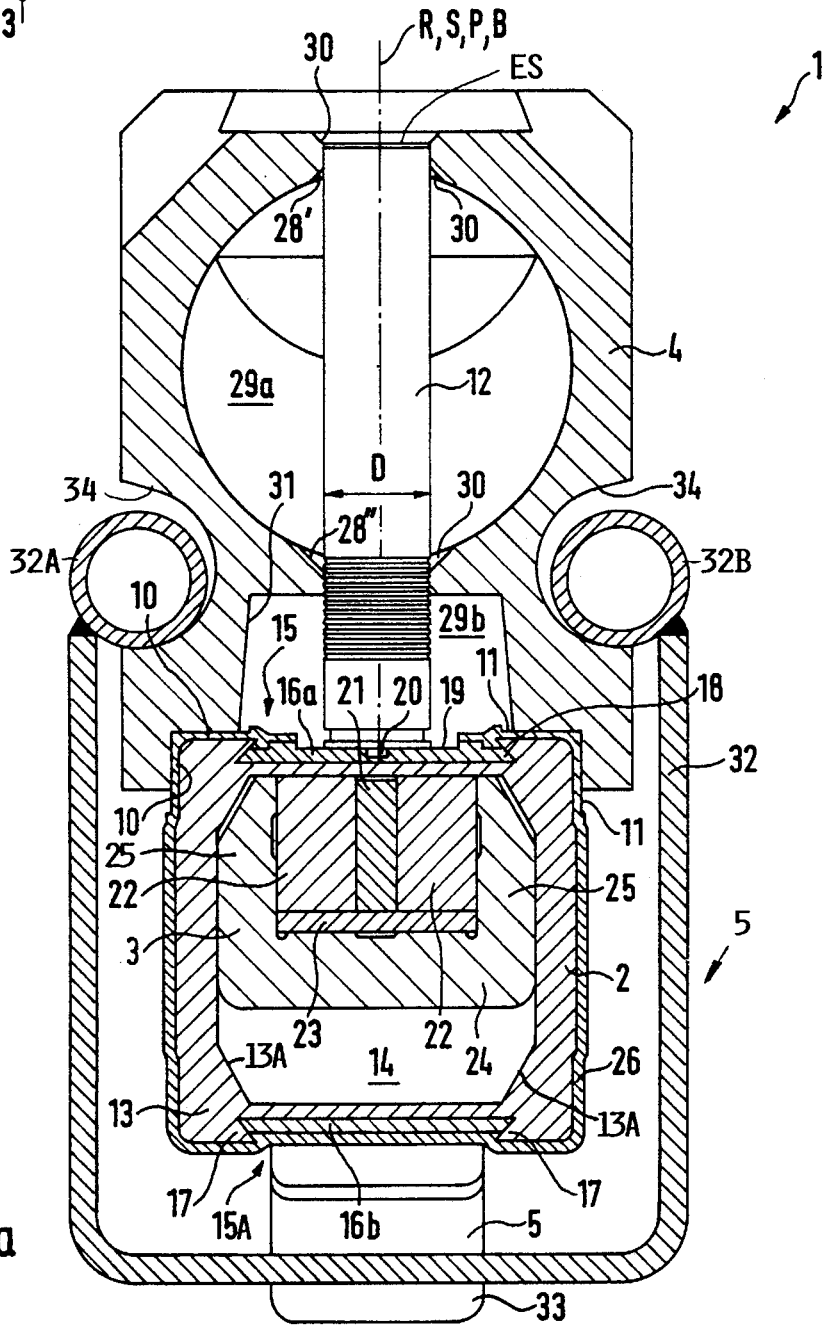
FIG. 3*a* shows on a still further enlarged scale a sectional view along section line III*a*—III*a* in FIG. 2.
Figure 5:
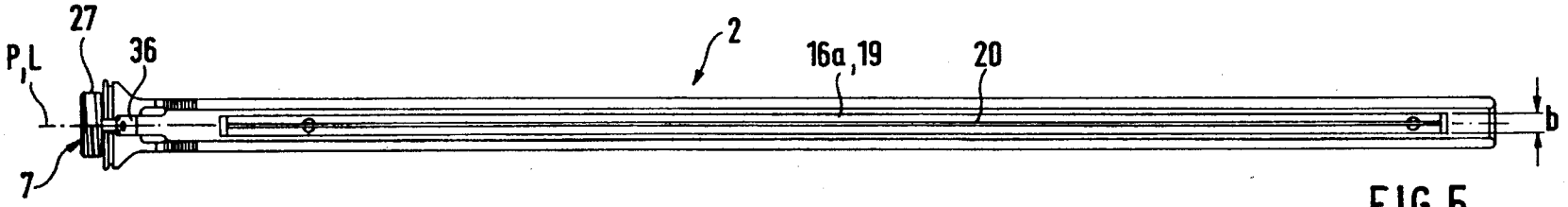
FIG. 5 is a top plan view of the hollow parts carrier with an electrically conducting plate secured to the top side of the carrier.

The exploded view of FIG. 1 shows components 2, 3, 4 and 5 of a parts holding and contacting device 1 according to the invention shown in its assembled state in FIG. 2. The device 1 comprises a hollow, elongated carrier 2, an elongated bar magnet 3, a cover 4, and mounting elements 5 for securing the cover 4 to the carrier 2 as will be described in more detail below. A closure cap 6 closes one end of the hollow carrier 2. The opposite end of the carrier 2 is closed by a foot section 37 constructed for mounting the device 1, for example to a mounting disk as shown in the above mentioned copending application. A dash-dotted line 3A indicates that the elongated bar magnet 3 is longitudinally inserted into a hollow elongated channel formed inside the elongated carrier 2. A dash-dotted line 3B indicates that the mounting elements 5 are assembled with the carrier 2. An arrow 4A indicates that the cover 4 is assembled with the carrier 2 and with the mounting elements 5 to form the completed assembly or device 1 shown in FIG. 2. The left-hand end of the carrier 2 has an opening 7, shown in FIG. 5, for the insertion of the elongated bar magnet 3 when the closure cap 6 is removed. At least one sealing ring 8 is placed on a flanged end 9 of the carrier 2, whereupon the opening 7 is closed by the threaded closure cap 6. For this purpose the flanged end 9 of the carrier 2 has a threading 27 as shown in FIG. 5. Then the cover 4 with its guide surfaces 10 is placed onto the carrier 2 as best seen in FIG. 3*a*. The carrier 2 has plane support surfaces 11 which match the guide surfaces 10 so that upon assembly the cover 4 extends parallel to the carrier 2 with a tight fit. The carrier 2 and the cover 4 are then clamped together by the mounting elements 5 which include a plurality of bails 32, clamping leaf springs 33, and guide rods 32A and 32B seen in FIG. 3A. The mounting elements 5 form a releasable connection between the carrier 2 and the cover 4. The assembled structure shown in FIG. 2 can now be loaded with a set of parts 12 to be plated on a surface area exposed outside the cover 4. One part 12 is symbolically shown in FIG. 1.

Figure 3B:
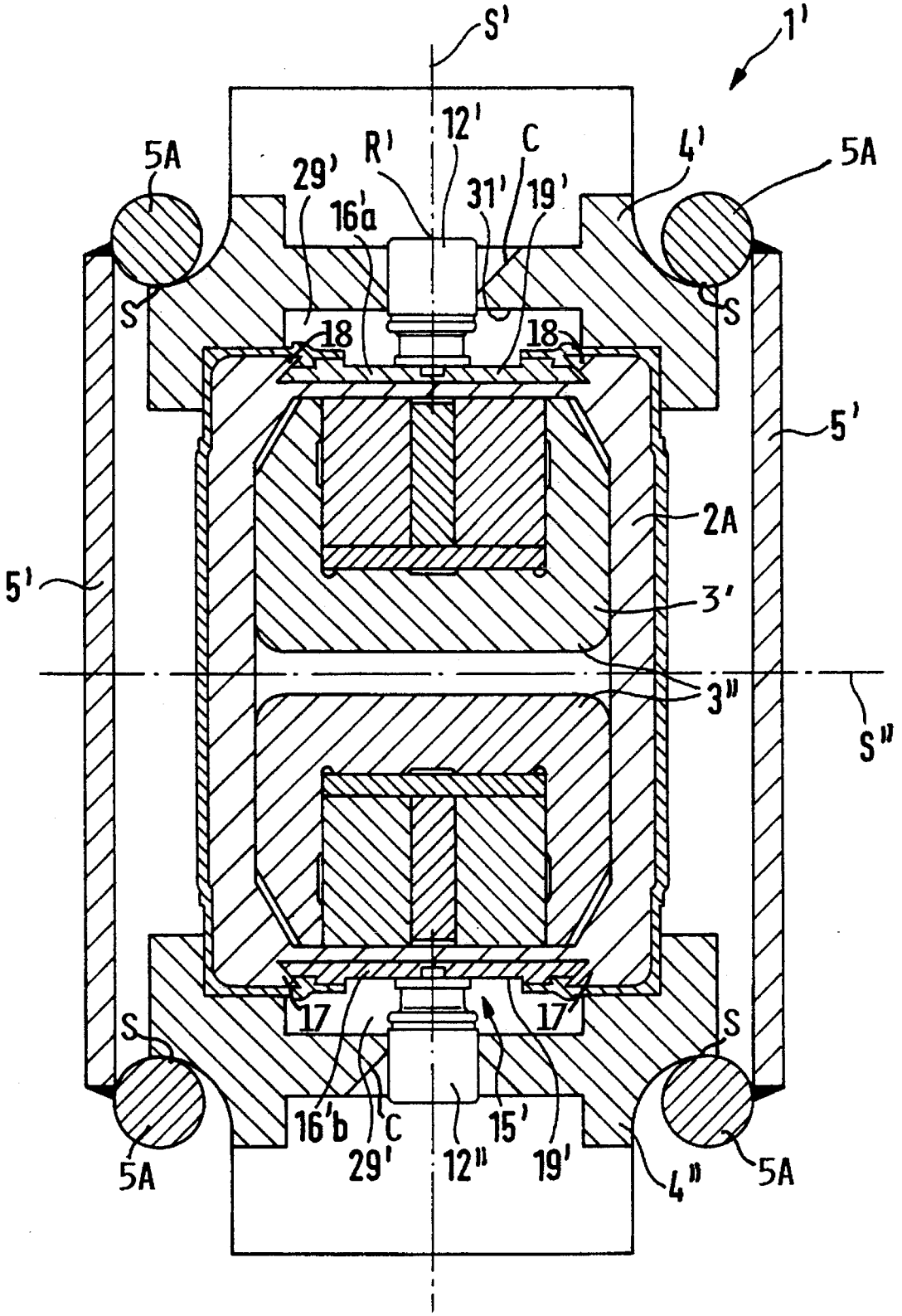
FIG. 3*b* shows a sectional view similar to that of FIG. 3*a*, however illustrating a double arrangement so that parts can be carried on two opposite sides of the device.

FIG. 3*a* illustrates a holder and contacting device 1 with one cover 4. FIG. 3*b* illustrates a similar device 1' with two magnets 3' and 3" in a common hollow carrier 2A cooperating with two covers 4' and 4".

Referring first to FIG. 3*a*, the three basic components 2, 3, 4 and 5 are illustrated in the cross-sectional view. The linear carrier 2 for the parts 12 is formed as a section cut off from a sectional pipe for example extruded aluminum having a substantially rectangular cross-section. Preferably all edges 13 of the tubular section enclosing a hollow channel 14 are strengthened by slanted wall sections 13A. These increased wall thicknesses at the corners 13 increase the bending stiffness of the carrier 2. The hollow channel 14 extends substantially over the entire length of the carrier 2. The ends of the channel 14 are closed as described above by the cap 6 and by the foot 37.

Figure 4:
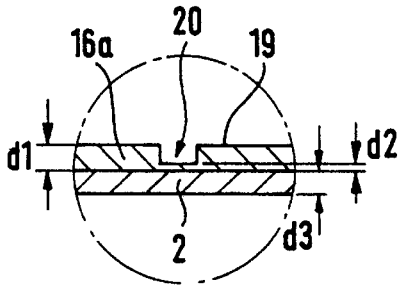
FIG. 4 illustrates a sectional view of an enlarged detail of a contact plate as used in FIGS. 3*a* and 3*b;*

The upper surface 15 and the lower surface 15A of the channel section forming the carrier 2 are provided with a dovetail recess or edge 18 and with a dovetail recess or edge 17, respectively. A metal plate or strip 16*a* preferably made of ferromagnetic material is received with a lateral location fit in the dovetail recess 18. A further metal plate or strip 16*b* preferably made of ferromagnetic material is received with a lateral location fit in the dovetail recess 17. The two metal plates 16*a* and 16*b* are preferably made of nickel plated steel sheet metal, for example. The dovetail recesses 17 and 18 provide a form-locking or location fit so that the strips or plates 16*a* and 16*b* are rigidly held in the direction crosswise to the longitudinal direction L extending perpendicularly to the drawing sheet of FIG. 3*a*. However, in the longitudinal direction L the plates 16*a* and 16*b* are able to expand and contract in response to temperature changes, whereby buckling of these plates is prevented and the plates are kept plane for good contact with the parts 12. The outwardly facing surface 19 of the plate 16*a* is a plane surface to assure a good electrical contact with the parts 12, a surface portion of which is to be galvanized or plated. The contact surface 19 extends in the longitudinal direction L and has an elongated rectangular configuration. The surfaces 19 of the plates 16*a*, 16*b* are preferably machined to be plane for properly contacting the parts 12 arranged in a row and also for a tight contact with the surfaces of the wall portions of the channel section on which the plates 16*a*, 16*b* rest. The surfaces of the wall portions e.g. 2' on which the plates rest are preferably also machined to be plane. Preferably, a groove 20 is machined centrally and longitudinally into the plate 16*a*, thereby interrupting the plane surface 19 as best seen in FIG. 4. The groove 20 has a rectangular cross-section.

Referring to FIG. 4, the electrically conducting metal plate 16*a* has a thickness d1 except where the longitudinal groove 20 reduces the thickness of the plate 16*a* to a smaller thickness d2. The upwardly facing wall 2' of the channel section forming the carrier 2 has a thickness d3 below the plate 16*a*. As shown in FIG. 5, the groove 20 extends along the entire length of the metal plate or strip 16*a* and thus along the entire contact surface 19 which has a width b shown in FIG. 5. The width b of the contact surface 19 is slightly larger than the diameter D of the parts 12 shown in FIG. 3*a*, thereby providing the possibility of accommodating parts to be plated having different diameters provided that a different cover with different diameter receptacles 28 for the larger diameter parts is clamped to the carrier 2.

In FIG. 3*b* components that correspond to respective components in FIG. 3*a* are provided with the same reference numbers, however distinguished by a prime. The upwardly facing cover 4' masks parts 12' and the downwardly facing cover 4" masks parts 12". In both instances the upwardly and downwardly axially facing surfaces and a portion of the cylindrical surface of each part 12', 12" are plated. This is possible because the cylindrical surface portions are accessible to the plating bath due to the substantial chamfer C around each receptacle 28 or part holding bore.

The carrier 2A of FIG. 3*b* has a rectangular cross-section and holds two permanent rod magnets 3' and 3" in a mirror-symmetrical arrangement relative to a horizontal mirror-plane S" and also in a mirror-symmetrical arrangement relative to a vertical mirror plane S'. As shown, the clamping elements 5' with their clamping rods 5A differ from the clamping elements 5 of the embodiment shown in FIG. 3*a*. However, the operation of the clamping elements 5', 5A is substantially the same in that the clamping rods 5A cooperate with shoulders S of the covers 4' and 4" to hold the entire assembly together in a tight yet releasable manner.

The parts 12 in FIG. 3*a* and 12' in FIG. 3*b* are, for example, rod-shaped parts that may be hollow and produced on an automatic lathe, for example cut-off from cylindrical stock. The rotational longitudinal axis R of the part 12 in FIG. 3*a* and the rotational axis R' of the parts 12', 12" in FIG. 3*b* coincide with the axis S or S' respectively. Further, these rotational axes R and R' extend perpendicularly to the longitudinal axis L. Thus, the parts 12, 12', 12" extend perpendicularly to the contact surface 19 or 19' respectively. The respective magnet 3, 3', and 3" holds all the work pieces in place. For this purpose the respective magnet extends in parallel and alongside the steel sheet metal strips 16*a* or 16'*a* or 16'*b*. The pole axis or pole plane P coincides with the symmetry axis S, S' and with the rotational axis R, R'. As a result, the magnetic field lines are optimally oriented for a better holding of the parts 12, 12', 12" on the plates 16*a*, 16?*a*, and 16?*b*. While the use of these plates is preferred, their use is optional because the parts can be held in place directly on the machined surfaces of reduced thickness wall portions 2' of the channel section forming the carrier 2.

Each of the magnets 3, 3', and 3" is constructed in the same manner. Two pole rods 22 having a rectangular cross-section are spaced from each other by an intermediate piece 21 which is bridged by a magnetic yoke 23 that contacts the two pole rods 22. The elements 21, 22 and 23 are held in a magnet carrier 24 having a U-shaped cross-section with U-flanks or legs 25 between which the elements 21, 22 and 23 are held in place. Due to the magnetic force exerted by the magnet 3 on parts 12 and on the ferromagnetic metal strip 16*a*, the pole rods 22 adhere in a surface contact to the surfaces of the wall portion 2' of the carrier 2. The wall portion 2' is planed by machining as mentioned.

The ferromagnetic metal plate or strip 16*a* with its longitudinal groove 20 has a substantial influence on the distribution of the magnetic field lines and thus of the concentration of the magnetic field strength where it is most effective to hold the parts 12. The horizontal width b of the plate 16*a* between the dovetail edges 18 is wider and the length of the plate is longer than the width and length of the pole rods 22, whereby a certain screening effect for the magnetic field is achieved. Thus, the magnetic force or holding force for fixing the parts 12 centrally above the groove 20 can be determined or initially adjusted by the remaining thickness d2 of the groove bottom 20 of the metal plate 16*a* and by the wall thickness d3 of the upper wall 2' of the carrier 2 between the magnetic strip or plate 16*a* and the upwardly facing surfaces of the pole rods 22 of the magnet 3. The just described arrangement of the elements that influence the magnetic field lines, relative to each other, namely the arrangement of the ferromagnetic plate 16*a* between the magnet 3 and the parts 12 makes it possible that the parts 12 are fixed or secured to the device 1 without disturbing the coating or plating by the magnetic field lines during galvanizing.

The parts carrier 2 is protected against adverse electrochemical influences caused by the galvanic bath by a protective coating 26 except where the contact surface 19 is exposed to be contacted by the parts 12, 12', 12". All other electrical contact areas are coated by the protective coating 26 preferably of polytetrafluoroethylene. The surface areas 11 are planed by machining for providing a close and tight contact with the surfaces 10 of the cover 4 as mentioned above. The protective coating 26 even covers the longitudinal edges of the plate 16*a*, 16*a'* and 16*b'*. For this purpose the edges of the protective coating 26 grip in a dovetail manner behind the edges 17, 18 of the dovetail groove or recess. The just mentioned plane surfaces 11 in their cooperation with the guide surfaces 10 assure a central positioning of the cover 4 on the carrier 2.

Referring to FIG. 5 the opening 7 at the left-hand end of the channel section forming the carrier 2 is still open because the cap 6 has not yet been screwed onto the threading 27 on the flanged end 9. In this state the bar magnet 3 may be inserted into the carrier 2 as shown in FIG. 1 and the opening 7 may then be closed by the cap 6 as shown in FIG. 2. A soldering tab 36 is either connected to the cap 6 or directly to the ferromagnetic electrically conducting plate 16*a* as shown in FIG. 5. In both instances the carrier 2 is connected to the current supply of the galvanizing bath through the tap 36. Once the carrier 2 is closed at both ends as described, the magnet 3 is fully protected against adverse influences of the galvanizing bath.

Figure 6:
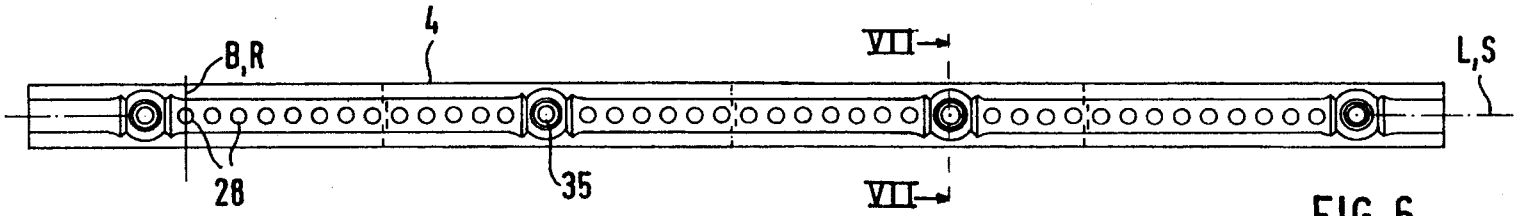
FIG. 6 is a top plan view of the cover to be secured to the carrier of FIG. 5.

Referring to FIGS. 3*a* and 6, the cover 4 comprises a plurality of bore holes arranged in a row and forming receptacles 28 for the parts 12 which have a rotational symmetry relative to the axis R or S. In the embodiment of FIG. 3*a* each bore hole has two sections 28' and 28". These sections are axially aligned with each other to form the receptacles 28 shown in FIG. 6. Both edges of the upper bore hole section are chamfered at 30 while only the inwardly facing edge of the hole section 28" has a chamfer 30. The central axis B of the bore hole sections 28', 28" coincides with the central axis R and the axis of symmetry S. As shown in FIG. 6 the receptacles 28 in their row are uniformly spaced from each other so that adverse, interfering influences during the coating of the parts 12 are avoided.

The cover 4 of FIG. 3*a* forms a rinsing channel 29*a*. By rinsing a rinsing liquid through the channel 29*a* it is assured that the cylindrical surfaces of the parts 12 within the channel 29*a* are not plated. Further, the cover is made of electrically insulating material so that the current density inside the channel 29*a* drops below the critical current density necessary to sustain deposition. Only the axially facing end surface ES of the part 12 is to be plated. For this purpose this surface ES is slightly recessed below the upper chamfer 30.

Referring further to FIG. 3*a* the chamfers 30 also facilitate the insertion and removal of the parts into the receptacles 28.

FIG. 3*a* shows a further rinsing channel 29*b* formed by a groove 31 in the lower portion of the cover 4. This rinsing channel 29*b* makes sure that the cylindrical wall portions of the parts 12 below the hole section 28" are not plated.

In FIG. 3*b* the axially facing surfaces of the parts 12', 12" are plated and a substantial cylindrical surface portion as exposed by the chamfer C is also plated or coated. Two rinsing channels 29' make sure that the cylindrical surface portions of the parts 12', 12" below the respective receptacle in the cover are not plated. The rinsing channels 29*a*, 29*b*, and 29' are open at their ends and communicate with the groove 20 so that hollow parts can be rinsed even on the inside when the entire assembly is immersed in a rinsing bath. In FIG. 3*a* the rinsing channel 29*b* communicates with the groove 20 to permit access of rinsing liquid into hollow parts which are closed at the upper end ES, the surface of which is to be plated.

The clamping connections 5, 5' shown especially in FIGS. 3*a* and 3*b* assure a tight connection between the carrier 2 and the cover 4 or the carrier 2A and the two covers 4' and 4" shown in FIG. 3*b*. These clamping connections nevertheless permit an axial expansion and contraction in response to temperature changes as mentioned. The clamping bail 32 reaches around the carrier 2 and the two guide bars 32A and 32B reach into the grooves 34 of the cover 4. In FIG. 3*b* the guide rods 5A bear against the shoulders S of the respective cover 4', 4".

The cap 6 and the foot section 37 make it possible to mount a plurality of assemblies 1 in a support rack or in a manner as described in the above mentioned copending application to form a cage type parts carrier.

Figure 7:
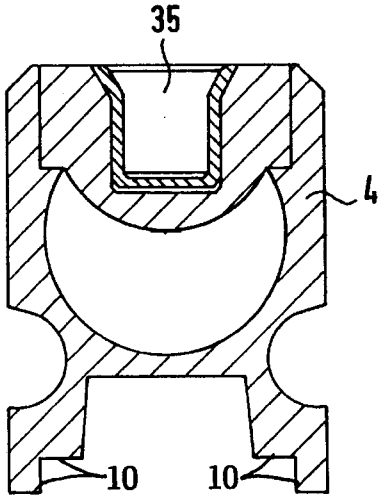
FIG. 7 is an enlarged sectional view along section line VII—VII in FIG. 6 to illustrate an alignment blind hole.

The sectional view of FIG. 7 shows a cover 4 with a locating dead end hole 35 that cooperates with a respective locating pin of a docking device not shown when the present holding and contact device is to cooperate with a loading an/or unloading apparatus not shown.

As mentioned, the carrier 2 is preferably formed of a profiled pipe section which is machined at least along one surface to provide the contact surface 19 either directly or to provide a plane contact surface for the plate 16*a*, 16*b*. The surface 19 extends in the longitudinal direction of the pipe section. Using such pipe section has an economic advantage in the manufacture of the present holding and contacting device. The required bending stiffness is also assured, especially by pipe sections having a rectangular cross-section with reinforced corners as described above. Such a pipe section further assures the required dimensional stability of the device especially under thermally changing operating conditions during the entire plating process. A high dimensional stability of the carrier 2 guarantees that the contact area or surface 19 between the parts 12 and the carrier 2 remains plane and is not adversely affected by the galvanizing current so that any vaulting of the contact surface 19 is avoided. This feature in turn assures reliably the required plating or coating quality of the parts 12, 12', 12" without faults.

A permanent magnet is preferably used to form the elongated bar magnet 3 for the holding of the parts 12, 12', 12" on the contact surface 19. A permanent magnet is more reliable for the present purpose than an electromagnet. By forming the magnet of two pole bars 22 with a yoke 23, a bi-polar magnet is provided in the limited inner space of the carrier 2 which is capable of generating a high magnetic force sufficient for strongly holding the parts 12 in place. It has been found that a disturbance of the quality of the coating by adverse effects caused by the magnetic field lines can be prevented by making the magnetic field line density small in the area of the surface portion to be plated. Making the field line density small in the area of the coating is achieved by respectively positioning the magnet 3 relative to the parts 12. By mounting the pole bars 22 of the magnets 3 between the flanks 25 of a U-shaped magnet carrier 24 which in turn is guided between the opposite inner walls of the carrier 2 forming the elongated channel 14 in the carrier 2 it is possible that the position of the magnet is centrally retained even if the carrier with its cover is repeatedly mounted in a galvanizing rack not shown. The just described construction makes sure that the magnet is positively centered between the inner wall of the carrier 2 at all times. This construction has the further advantage that the magnet can be easily removed and replaced by simply removing the cap 6 and pulling the entire magnet 3 with its magnet carrier 24 out of the channel 14 of the carrier 2 whereupon a new magnet can be simply pushed into the carrier 2.

The opening 7 in one end of the carrier 2 and the cap 6 for closing the opening are preferably located outside of the galvanizing bath so that neither the electrolyte of the bath, nor rinsing liquid can enter into the channel 14 in the carrier 2 during the plating or rinsing operation. The immersion of the carrier 2 into a rinsing bath must be such that the rinsing liquid can enter into the open ends of the rinsing channels 29*a*, 29*b* and 29'.

By connecting the electrical connector tab 36 through the screw cap 6 to the carrier 2 a good electrical connection is established, especially when the threadings are coated with a good electrical conductor. By constructing the tab 36 as a loop around the threaded end of the carrier 2 it is possible to even transmit mechanical loads through the tab from the carrier 2 to a rack so that even if the screw connection of the cap 6 should become loose, the full galvanizing current will still pass undisturbed through the connecting tab 36 into the electrode formed by the carrier 2.

In the above described preferred embodiment in which the plane contact surface 19 is formed as part of an intermediate ferromagnetic electrically conducting plate or strip 16*a*, 16*b*, the position of the magnetic field lines can be advantageously influenced by such ferromagnetic plate. Preferably, the plate 16*a*, 16*b*, 16*a'*, 16*b'* is a nickel plated strip of steel sheet metal that exhibits advantageous wear and tear characteristics and corrosion resistance providing a prolonged operational life of the contact surface 19. This is true especially when due to lightweight construction considerations and a desirable paramagnetic characteristic of the carrier 2, the latter is made of aluminum or an aluminum alloy. In this connection it is an advantage that the magnet 3 adheres to the respective inner wall of the carrier 2 even if the latter is not loaded with parts 12. The adherence is assured by the ferromagnetic metal strip 16, 16*a* even if the housing of the carrier 2 is made of aluminum or an aluminum alloy. Thus, the carrier 2 can be loaded with parts 12 in any position of the carrier without any additional need for fixing the magnet in a centered position. The location fit in the lateral direction provided by the dovetail mounting 17, 18 of the strip 16 assures that transition resistances are low and the current transmission between the carrier 2 and the contact surface 19 is free of disturbances and that the parts are held in place with the strip or plate 16, 16*a*.

The longitudinal groove 20 in the plate 16 is centrally positioned where the parts 12 are held in place by the force of the magnet on the carrier. In this position the plate 16 has the effect of an aperture with regard to the distribution of the magnetic field lines. Referring to FIG. 4 the thickness d1 of the plate 16*a* outside the groove 20 in combination with the thickness d3 of the respective wall portion 2' of the carrier 2 act in the manner of a screen on the magnetic field lines to limit their spreading. Contrary thereto in the area of the groove 20 the magnetic field lines penetrate the wall portion 2' substantially undiminished so that the parts 12 are solidly fixed in position on the contact surface 19.

Another advantage of the groove 20 is the above mentioned rinsing even of the inner space in sleeve-type parts 12 because the rinsing liquid can pass through the groove which extends uninterrupted along the length of the plate 16. The provision of the further metal strip 16*b* on the carrier 2 opposite the first metal strip 16*a* enhances the symmetric construction of the carrier 2 so that deformations in the manner of a bi-metal due to varying thermal operating conditions are avoided.

By coating the carrier 2 with a synthetic material in such a way that the protective coating 26 covers the entire outer surface of the carrier 2 except where the contact surface 19 is located and except for the electrical contact tabs 36, the carrier 2 is protected against corrosive influences by the electrolyte or by the rinsing liquid. The coating 26 is preferably of polytetrafluoroethylene which is especially resistant against chromic-sulfuric acid. Thus, a carrier 2 protected by polytetrafluoro-ethylene can be used for chrome plating of parts 12.

In order to assure a proper positioning of the cover 4 and the carrier 2 relative to each other and to connect these elements 2 and 4 tightly to each other, the coating 26 has the machined surface areas 11 to provide plane surfaces which permit a relative sliding movement between cover 4 and carrier 2 in the longitudinal direction, especially when the coating 26 is polytetrafluoroethylene so that the advantage is achieved that certain thermally caused expansion differences are easily compensated. The form-locking or location fit dovetail connection between the coating 26 along its edges at 17 and 18 prevents an undesirable or premature peeling of the coating 26 that could otherwise be caused by liquid penetration between the coating and the surface of the carrier 2. The construction of the cover 4 of FIG. 3*a* or the cover 4', 4" of FIG. 3*b* permits masking the parts 12, 12' as desired. Thus, in the recessed position permitted by the two axially aligned bore holes 28', 28" in FIG. 3*a* it is assured that only the end surface ES of the part 12 is plated. Similarly, the chamfer C in FIG. 3*b* permits plating the end surfaces and a portion of the cylindrical jacket surface of the parts 12', 12". As shown in FIG. 3*b* the loading capacity or carrying capacity of the carrier 2A is increased by the symmetrical construction so that parts 12', 12" can be held in two rows as shown, whereby each row is masked by its respective cover 4' and 4". The so constructed covers provide an automatic masking against direct contact by the current carrying electrolyte so that individual masking operations are avoided at substantial economical advantage.

Due to the shown construction of the various covers, the areas to be plated are directly in contact with the current carrying electrolyte while all portions or rather surfaces areas of the parts not to be plated are masked by the cover. These covers are provided with the receptacles 28 in such a way that the receptacles are adapted to the contour or configuration and diameter of the respective parts. Where the parts to be coated are cylindrical or lathe produced, circular bore holes 28', 28" can be easily produced in the cover, whereby the bore diameter is adapted to the diameter D of the respective part. The chamfers 30 or C also facilitate the loading of parts. Depending on the size of the chamfer, the size of the cylindrical surface area to be plated can be determined as well as the geometry of the plating. For example, it is possible to provide the surface ES with a plating layer having a conical or rather a conical frustum configuration.

The above mentioned rinsing channels 29*a*, 29*b* and 29' permit a rinsing of the cover and of the parts 12 during the galvanic plating process or during a separate rinsing operation. These rinsing channels extend preferably in the longitudinal direction of the cover, whereby surface areas of the parts 12 inside the cover can be wetted by the rinsing liquid in a sequential order. The cover itself is preferably made of an electrically insulating material so that a plating or coating of surface areas of the parts within the rinsing channel is avoided even when the parts are immersed into the galvanic plating bath. This is accomplished in that the current density in the rinsing channel is lowered to such an extent by the electrically insulating cover that a plating is avoided.

The above mentioned location fit in a crosswise direction between the cover and the carrier 2 nevertheless permits an axial compensation of small axial displacements of the cover and carrier relative to each other in the longitudinal direction of the plane remaining surface areas 10 and 11 without any disturbance in the current passage.

Although the invention has been described with reference to specific example embodiments, it will be appreciated that it is intended to cover all modifications and equivalents within the scope of the appended claims.

What is claimed is:

1. A holding and contacting apparatus for galvanically coating parts to be plated on at least one part surface, comprising at least one hollow elongated parts carrier (2) of electrically conducting material enclosing an elongated channel (14), at least one elongated magnet (3) mounted in said elongated channel (14), an electrical connector tab (36) for feeding a plating current to said hollow parts carrier (2), an electrically conducting contact surface (19) extending along one side of and in contact with said parts carrier (2) and along said magnet (3), said elongated magnet (3) having a pole axis (P) extending perpendicularly to said contact surface (19).

2. The apparatus of claim 1, wherein said parts carrier (2) comprises a hollow pipe section of electrically conducting material, and wherein said contact surface extends in a longitudinal direction (L) of said hollow pipe section.

3. The apparatus of claim 2, wherein said pipe section comprises a rectangular cross-section.

4. The apparatus of claim 1, wherein said magnet (3) is a permanent magnet.

5. The apparatus of claim 1, wherein said magnet comprises two pole rods (22) extending with a spacing between the pole rods (22) in parallel to each other, said pole rods having different magnetic polarities.

6. The apparatus of claim 5, further comprising a magnet yoke (23) interconnecting said pole rods (22) at pole ends away from said contact surface (19) for increasing a magnet force.

7. The apparatus of claim 5, further comprising a magnet carrier (24) having a U-cross-section with flanks (25), said pole rods (22) of said magnet (3) being positioned between said flanks (25), said hollow parts carrier (2) having at least two walls positioned opposite each other, said magnet carrier (24) being positioned between said two walls of said hollow parts carrier (2).

8. The apparatus of claim 7, wherein said hollow parts carrier (2) comprises an opening (7) for the insertion and removal of said magnet (3) and said magnet carrier (24), said hollow parts carrier (2) further comprising a closure (6) for said opening (7).

9. The apparatus of claim 8, wherein said opening (7) is an end opening at one end of said elongated channel (14) for the lengthwise insertion of said magnet (3) and said magnet carrier (24), said end opening being spaced from a nearest of said parts.

10. The apparatus of claim 9, wherein said closure is an electrically conducting cap (6), wherein said electrical connector tab (36) is connected to said cap (6) in an electrically conducting manner, and wherein said cap (6) is electrically connected to said parts carrier (2).

11. The apparatus of claim 10, wherein said cap (6) and said end opening of said hollow carrier (2) each have a threading (27) for screwing said cap to said end opening.

12. The apparatus of claim 11, wherein said threading of said cap (6) and said threading (27) of said end opening of said hollow carrier (2) have an electrically conducting coating or plating having a good electrical conductivity.

13. The apparatus of claim 12, wherein said cap (6) comprises an extension with a threading for a mechanical and electrical connection of said hollow parts carrier in a plating apparatus.

14. The apparatus of claim 1, further comprising an electrically conducting contact plate (16) forming at least one metal strip (16*a*) and wherein said hollow parts carrier (2) comprises location fit elements (18) holding said at least one metal strip in place along a carrier side where said hollow parts carrier holds said parts (12) with said magnet (3).

15. The apparatus of claim 14, wherein said metal strip (16*a*, 16*b*) rests with an area contact on a wall portion (2') of said hollow parts carrier (2), said wall portion (2') extending between said magnet (3) and said metal strip (16*a*, 16*b*).

16. The apparatus of claim 1, further comprising a metal strip forming said electrically conducting contact surface (19) having a recess (20) where said metal strip has a reduced thickness (d2), said recess (20) being positioned where parts (12) are held along said hollow parts carrier.

17. The apparatus of claim 16, wherein said recess (20) is a longitudinal groove in said metal strip.

18. The apparatus of claim 14, further comprising a second electrically conducting metal strip (16*b*), said hollow parts carrier comprising further location fit elements (17) positioned to hold said second metal strip (16*b*) in place opposite said first metal strip (16*a*) and in parallel to said first metal strip.

19. The apparatus of claim 1, wherein at least said contact surface of said contact plate (16) comprises a nickel plating or coating.

20. The apparatus of claim 1, wherein said hollow parts carrier (2) is made of a paramagnetic material.

21. The apparatus of claim 1, wherein said hollow parts carrier (2) comprises at least one electrical contact area and an electrochemically resistant coating (26) on outer surfaces of said carrier (2) except where said contact surface (19) contacts said carrier (2).

22. The apparatus of claim 21, wherein said electrochemically resistant coating (26) is a synthetic material.

23. The apparatus of claim 21, wherein said electrochemically resistant coating (26) has planar support surface areas (11).

24. The apparatus of claim 1, further comprising a cover (4), a plurality of part receptacles (28) each for masking one part (12) in said cover (4), and mounting elements (5) securing said cover (4) to said hollow parts carrier (2) so that said cover extends in parallel to said contact surface (19), said receptacles (28) positioning said parts to be held in place by said bar magnet.

25. The apparatus of claim 18, further comprising two covers (4, 4'), and mounting elements (5A, 5') securing said covers to said hollow parts carrier (2') so that said covers (4, 4') extend in parallel to said metal strips (16*a*, 16*b*), respectively, each of said covers comprising a plurality of part receptacles (28) arranged in at least one row along the respective contact strip.

26. The apparatus of claim 24, wherein said cover comprises at least one rinsing channel (29*a*, 29*b*, 29') extending along said part receptacles (28) for passing a rinsing fluid through said rinsing channel into contact with parts' surfaces not to be plated.

27. The apparatus of claim 26, wherein said cover has a longitudinal groove facing said carrier, so that said channel is formed by said cover and by said parts carrier.

28. The apparatus of claim 26, wherein said cover comprises a longitudinal bore forming said rinsing channel.

29. The apparatus of claim 28, wherein said receptacles are bores for cylindrical parts in said cover, each receptacle bore having two bore sections positioned in axial alignment with each other on diametrically opposite sides of said longitudinal bore, whereby a central axis (B) of said bore sections (28', 28") extends perpendicularly to said contact surface (19) to assure a plane contact between said parts and said contact surface.

30. The apparatus of claim 29, wherein said bore sections (28', 28") have at least one bevelled rim (30).

31. The apparatus of claim 24, wherein said mounting elements comprise elastically yielding clamps (32, 32A; 5', 5A) for interconnecting said cover (4, 4') with said carrier (2, 2').

32. The apparatus of claim 24, wherein said cover (4, 4') is made at least partly of an electrically insulating, electrochemically resistant material.

33. The apparatus of claim 24, further comprising positioning elements such as locating holes (35).

34. The apparatus of claim 1, wherein said hollow parts carrier (2) has a mirror-symmetrical configuration relative to a central mirror plane.

35. The apparatus of claim 1, further comprising an electrically conducting contact plate (16) forming said contact surface (19), wherein said electrical connector tab (36) is directly connected to said electrically conducting contact plate (16).

36. The apparatus of claim 1, wherein said magnet (3) is removably mounted in said elongated channel (14).

* * * * *

UNITED STATES PATENT AND TRADEMARK OFFICE

CERTIFICATE OF CORRECTION

PATENT NO. : 5,618,396

DATED : April 8, 1997

INVENTOR(S) : Hiermaier et al.

It is certified that error appears in the above-indentified patent and that said Letters Patent is hereby corrected as shown below:

Col. 5, line 38, replace "16?a and 16?b" by --16'a and 16'b--.

Signed and Sealed this

Fifth Day of August, 1997

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,618,396

DATED : April 8, 1997

INVENTOR(S) : Hiermaier et al.

It is certified that error appears in the above-indentified patent and that said Letters Patent is hereby corrected as shown below:

On title page, in [73] Assignee: the Assignee information should read as follows:

--MTU Motoren- und Turbinen-Union Muenchen GmbH, Muenchen, Federal Republic of Germany and BL Produktions GmbH, Tittling, Federal Republic of Germany--.

Signed and Sealed this

Eleventh Day of November, 1997

Bruce Lehman

*Attest:*

BRUCE LEHMAN

*Attesting Officer*

*Commissioner of Patents and Trademarks*